United States Patent [19]

Emmett

[11] 4,302,876

[45] Dec. 1, 1981

[54] RAZOR BLADE WITH INCLINED EDGE

[75] Inventor: James S. Emmett, Ansonia, Conn.

[73] Assignee: Warner-Lambert Company, Morris Plains, N.J.

[21] Appl. No.: 130,484

[22] Filed: Mar. 14, 1980

[51] Int. Cl.[3] ..... B26B 21/02; B26B 21/22

[52] U.S. Cl. ..... 30/47; 30/50; 30/63; 30/346.58

[58] Field of Search ..... 30/41, 47, 50, 279 R, 30/304, 305, 346.58, 62, 63

[56] References Cited

U.S. PATENT DOCUMENTS

| | | | |
|---|---|---|---|
| 1,321,640 | 11/1919 | Illmger | 30/279 R X |
| 1,579,844 | 4/1926 | Smith | 30/41 X |
| 1,817,579 | 8/1931 | Petard | 30/279 R X |
| 2,776,478 | 1/1957 | Mercer | 30/63 X |
| 2,817,146 | 12/1957 | Roberts | 30/50 X |
| 3,771,223 | 11/1973 | Dawidowicz | 30/50 X |
| 4,063,354 | 12/1977 | Oldroyd | 30/50 X |
| 4,084,316 | 4/1978 | Francis | 30/50 X |
| 4,146,958 | 4/1979 | Chen | 30/47 |
| 4,168,571 | 9/1979 | Francis | 30/50 X |
| 4,184,246 | 1/1980 | Trotta | 30/47 |

*Primary Examiner*—Gary L. Smith
*Attorney, Agent, or Firm*—R. S. Strickler

[57] ABSTRACT

A tandem edge razor blade cartridge has two blades with edge portions bearing cutting edges that are in a spaced-apart, parallel relationship. One of the blades has a major portion, behind the edge portion, bent at a substantial angle to the edge portion, away from the other blade, so that the gap behind the edge portions is greater than that between the edge portions themselves. Other embodiments include one or both blades each having a major portion comprising two components, one at an angle to the edge portion away from the other blade, the second component bent, at the same angle, to the first, back toward the other blade. As a result the second component is parallel to the edge portion, but displaced further than it is from the other blade. Additionally, an embodiment is provided in which the razor blade support has resilient apparatus to allow independent motion of the blades.

3 Claims, 8 Drawing Figures

RAZOR BLADE WITH INCLINED EDGE

BACKGROUND OF THE INVENTION

The invention relates generally to wet shaving systems, and particularly to razor blade assemblies for such systems.

One of the more significant changes in safety razor systems in recent years has been the introduction of the dual blade system, in which two spaced-apart blades are secured to a razor or in a cartridge with their cutting edges in parallel. A problem that arises from the use of such systems is the accumulation of debris between the blade cutting edges. Particularly in those blade assemblies employing the newer, long-lasting razor blades, where longer use allows more debris to accumulate, there exists a need to provide for the rinsing away of such debris.

One solution that has been attempted is making the elements spacing the blades from each other as small and/or discontinuous as possible to allow a flow of rinse water between the blades from front to rear with as little interference as possible. Examples of such minimal blade spacing structures are illustrated in U.S. Pat. No. 3,890,704 (Ferraro) and U.S. Pat. No. 4,016,648 (Chen et al.).

Another means for promoting the flow of rinse water between a pair of spaced blades is provided by arrangements which employ narrow blades as shown in U.S. Pat. No. 3,660,893 (Welsh), U.S. Pat. No. 3,940,853 (Francis), U.S. Pat. No. 4,063,357 (Francis), and U.S. Pat. No. 4,168,571 (Francis). Such very narrow blades are not standard in the razor blade industry, however, and they present formidable grinding and finishing problems which would require significant capital outlay for new or modified equipment if the manufacturer were to adopt them. Further, precision welding of very narrow blades to wire supports with the high accuracy and low distortion requirements of typical modern shaving products present additional technological challenges and capital outlay.

It is, therefore, an object of this invention to provide a dual blade razor assembly that is easier to rinse. It is another object to provide an easily rinsable dual razor blade assembly that is economical to manufacture and assemble, using existing manufacturing and assembling techniques. It is a further object to provide a twin razor blade assembly incorporating the advantages of the foregoing objects and additionally permitting resilient displacement relative thereto by at least one of the razor blades.

SUMMARY OF THE INVENTION

A razor blade assembly comprises a pair of razor blades in a spaced-apart relationship in a blade support assembly. Each blade has a planar edge portion with a longitudinal cutting edge and a major portion continuous with the planar edge portion. The razor blades are supported in the assembly with the planar edge portions spaced apart and parallel, and with the major portion of at least one of the razor blades bent at a substantial angle to its planar edge portion, so that the gap between the major portions of the razor blades is greater than the gap between their planar edge portions to allow greater rinsability of the assembly. In preferred embodiments the major portions of the blades are planar, and in one particular embodiment the major portions of the blades are also entirely prallel.

In another embodiment of the invention, all the portions of one of the blades are coplanar, and the other blade has its major plane bent at an angle so that the major portions of the two blades diverge behind the planar edge portions.

In yet another embodiment, one of the blades has its major portion divided into two components. The first component bends away from the planar edge portion at an angle away from the other blade, but then the second component, continuous with the first, bends back towards the other blade at the same angle so that the second component is parallel to the edge portion. In still another embodiment, both blades assume the same double bend configuration. In a further embodiment, one blade has a major portion with two components, the first at an angle to the planar edge portion, and the second component at an angle to the first so that the second component is parallel to the planar edge portion but displaced further away from the other blade. The other blade has a major portion bent at a substantial angle from a planar edge portion away from the first blade.

In a still further embodiment, a blade assembly comprises a pair of blades structured and positioned in any of the aforementioned configurations and being supported for limited resilient displacement in the plane of the major planar portion transversely of the blade edge and relative to one another and/or the blade supporting structure.

BRIEF DESCRIPTION OF THE DRAWINGS

Other objects, features and advantages of the invention will be pointed out hereinafter, or will be apparent from the following description of preferred embodiments of the invention, including the drawings thereof, in which.

DESCRIPTION OF PREFERRED EMBODIMENTS

Figure 1:
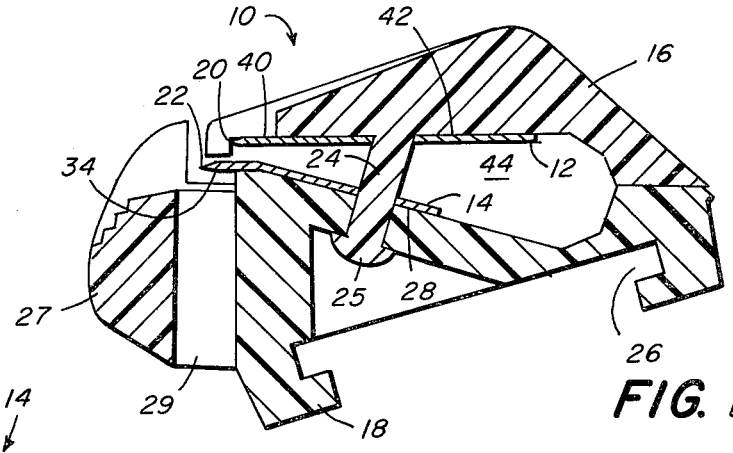
FIG. 1 is an elevational view, partially in section, of a razor blade cartridge embodying the invention.

Referring to FIG. 1, there is shown a razor blade cartridge 10 including an upper blade 12 and a lower blade 14 bonded permanently between a cap member 16 and a blade seat member 18. The blades 12, 14 each have a single cutting edge 20, 22 and are maintained in a vertically separated relationship by suitable structure or elements (not shown). Such structure might be, for example, the standoff posts shown in U.S. Pat. No.

4,016,648, expressly incorporated by reference herein. Other conventional spacing means, well known to those skilled in the art, may also be used to separate the blades 12, 14 and hold them in position. The cap member 16 has posts 24 extending downwardly through the blades 12, 14 through the blade seat member 18. The lower ends 25 of the posts 24 are staked or otherwise deformed to permanently bond the components of the razor blade cartridge 10 together. The cartridge 10 has a T-shaped channel 26 formed in the blade seat member 18 for releasably securing the cartridge 10 on a holder (not shown). A guard bar 27 is supported forwardly of the blade seat member 18 by spaced support elements 29.

Figure 2:
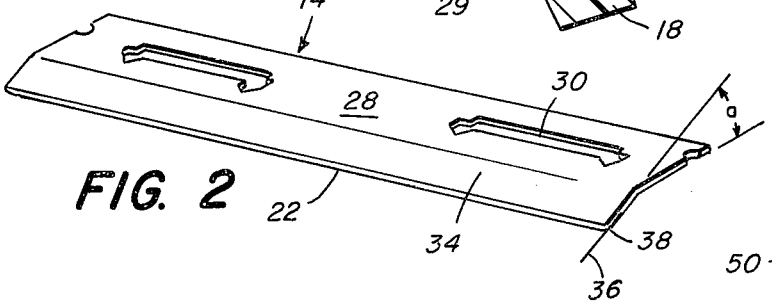
FIG. 2 is a perspective view of the lower blade of the razor blade cartridge shown in FIG. 1.

The lower blade 14 is shown in greater detail in FIG. 2. As shown in the drawing, the blade 14 generally has the characteristics of a conventional razor blade in terms of material composition, thickness and width. Rather than being uniplanar like a conventional blade, however, the lower blade 14 has two planar portions. The blade 14 includes a planar major portion 28 with a pair of slots 30 for passage of the bonding posts 24 and for the passage of the support and spacing posts mentioned earlier (not shown).

The elongate cutting edge 22 of the lower blade 14 is at one edge of a planar edge portion 34 which is continuous with the major portion 28 of the blade 14, but is bent at a substantial angle, designated a, to the major portion 28. As a result, a line 36 bisecting the included angle formed by the intersecting facets 38 forming the cutting edge 22 will be at nearly the same angle a to the major portion 28. This is because the cutting edge facets 38 are usually formed so that the line 36 bisecting the included angle is parallel to the single plane of a conventional blade.

Referring back to FIG. 1, the upper blade 12 is in conventional form. The planar edge portion 40 and planar major portion 42 of the upper blade 12 are coplanar. The upper blade 12 and the lower blade 14 are supported in the cartridge 10 so that their planar edge portions 40, 34 are in a parallel, spaced-apart relation with the cutting edges 20, 22. The cutting edges 20, 22, in effect, are oriented as they would be in a conventional tandem edge razor. However, the major portions 28, 42 of the blades 12, 14 diverge by virtue of the angle a between the edge portion 34 and major portion 28 of the lower blade 14, with major portion 28 bent away from the upper blade 12. The gap 44 between the upper and lower blades 12, 14 behind the edge portions 34, 40, therefore, gradually increase in size, in a direction away from the cutting edges 20, 22.

In use, then, the razor cartridge 10 can be cleaned by directing a stream of water between the upper and lower blades 12 and 14. Water can be directed at the front of the blades where the accumulation of debris near the cutting edges 20, 22 is troublesome. The gap 44 opening up behind the closely spaced planar edge portions 34, 40 allows debris forced backward by the stream of water to be flushed away rapidly rather than be forced between narrowly spaced blades for the entire width of the blades as occurs in conventiona arrangements. The support structure for the blades in the cartridge 10 has openings, not shown in the drawing, for the passage of water through the back of the cartridge 10. If water is directed toward the blades 12, 14 from the rear, the concentration of the flow of water by the gap 44 increases the effectiveness and pressure of the flushing stream.

Figure 3:
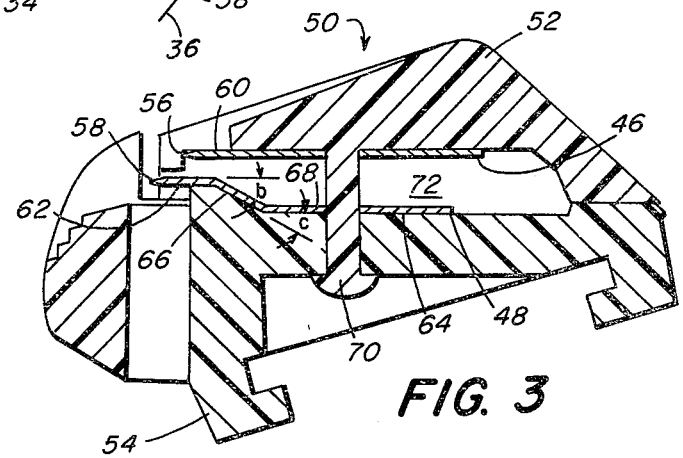
FIG. 3 is a view like that of FIG. 1, of a second embodiment.

Another embodiment of the invention, shown in FIG. 3, has upper 46 and lower 48 blades secured in a razor blade cartridge 50 similar to the cartridge 10 of the embodiment described previously. The cartridge 50 includes, as the earlier embodiment did, a cap member 52 and a blade seat member 54. The upper blade 46 and the lower blade 48 have cutting edges 56 and 58, respectively, at the front edges of parallel, spaced-apart, planar edge portions 60 and 62, respectively. The upper blade 46 is a uniplanar conventional blade.

The lower blade 48 in the embodiment of FIG. 3 has a major portion 64 divided into a first planar component 66 and a second planar component 68. The first component 66 is continuous with the planar edge portion 62 of the lower blade 48 and is bent at an angle b to it. The bend is away from the upper blade 46. The second component 68 is continuous ith the first component 66 and is bent up at an angle c to it, that is substantially equal to the first angle b. As a result, the second planar component 68 of the lower blade major portion 64 is substantially parallel to the lower blade planar portion 62. The second planar component 68 is accordingly also parallel to the single plane upper blade 46.

The second planar component 68 bears the securing and alignment holes, not shown, for the lower blade 48. Since the second component 68 is to be parallel to the upper blade 46, this allows the use of conventional cartridge assembling machinery adapted for the assembly of parallel blades. For example, a securing post 70 may be driven and stamped in a conventional manner through the parallel upper blade 46 and the second planar component 68 of the major portion 64 of the lower blade 48. Nevertheless, the double bend in the lower blade 48 provides a greater gap 72 between the blades 46, 48 by virtue of the downward displacement of the second planar component.

Figure 4:
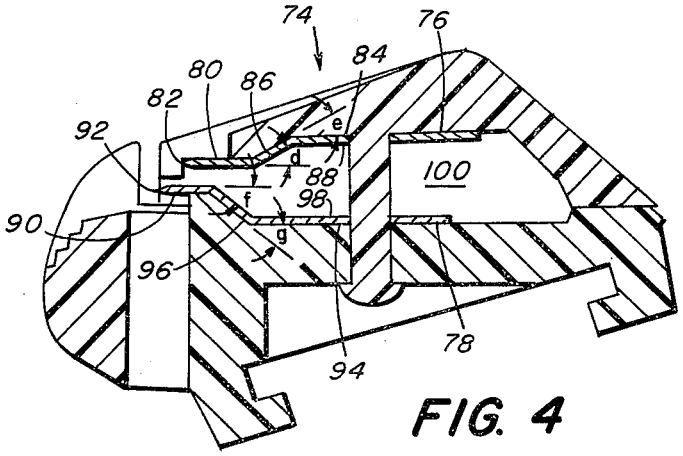
FIG. 4 is a view like that of FIG. 1, of a third embodiment.

A third embodiment, shown in FIG. 4, includes a razor blade cartridge 74 in which both the upper blade 76 and the lower blade 78 have a double bend, like the blade 48 shown in the previously described embodiment. The upper blade 76 of the third embodiment has a planar edge portion 80 with a cutting edge 82. It also has a major portion 84 with a first planar component 86 bent away from the lower blade 78 at an angle d to the planar edge portion 80, and a second planar component 88 bent at substantially the same size angle e to the first planar component 86 back toward the lower blade 78. As a result, the second planar component 88 is substantially parallel to the planar edge portion 80.

The lower blade 78 is similar in configuration to the upper blade 76. The lower blade 78 has a planar edge portion 90 with a cutting edge 92. It has a major portion 94 with a first planar component 96 bent away from the upper blade 76 at an angle f to the planar edvge portion 90, and a second planar component 98 bent at a substantially similar size angle g to the first planar component 96. The second planar component 98 of the lower blade 78 is, therefore, substantially parallel to the lower blade's planar edge portion 90.

The planar edge portions 80, 90 of the upper and lower blades 76, 78 are maintained in a spaced-apart, parallel relationship. Accordingly, the second planar components 88, 98 of the two blades 76, 78 are also in a spaced-apart, parallel relationship, but the gap 100 between the second planar components 88,, 98 is larger than the distance between the planar edge portions, 80, 90 by virture of the double bends in the blades 76, 78. As in the second embodiment described above, the securing and alignment holes are located in the second planar components 88, 98 of the blades 76, 78. Since the components 88, 98 are parallel, conventional assembling machinery, arranged for parallel conventional blades, may easily be adapted to assembling blades 88, 98 in a cartridge 74 of the of the third embodiment.

Figure 5:
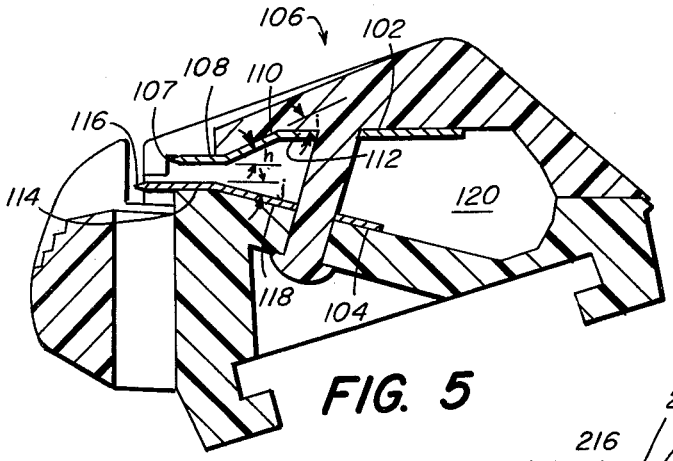
FIG. 5 is a view like that of FIG. 1, of a fourth embodiment.

The fourth embodiment, as seen in FIG. 5, has an upper blade 102 and lower blade 104 in a razor blade cartridge 106. The upper blade 102 has the double bend configuration of the type previously described. Namely, it has a cutting edge 107, a planar edge portion 108, a first major planar component 110 bent at an angle h to the planar edge portion 108, and a second major planar component 112 bent at an angle i to the first component 110. The second planar component 112 is parallel to the planar edge portion 108 but is displaced further away from the planar edge portion 108 from the lower blade 104.

The lower blade 104 has a single bend between a planar edge portion 114 bearing a cutting edge 116 and a major planar portion 118. The bend forms a substantial angle j between the planar portion 114 and the major portion 118. The major portion 118 bends away from the upper blade 102, so that the upper and lower blades 104 and 106 diverge, creating a gap 120 between the blades that increases the further back from the parallel front planar edge portions 107 and 114 one is.

Figure 6:
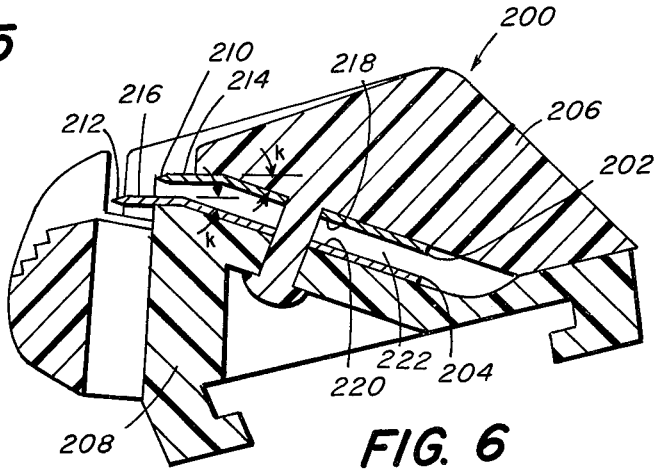
FIG. 6 is a view like that of FIG. 1, of a fifth embodiment.

The fifth embodiment, as seen in FIG. 6, comprises a razor blade cartridge 200 in which an upper blade 202 and a lower blade 204 are secured therein. The cartridge 200 includes a cap member 206 and a blade seat member 208. The upper blade 202 and the lower blade 204 have cutting edges 210 and 212, respectively, at the front edges of parallel, spaced-apart, planar edge portions 214 and 216, respectively. The upper blade 212 and the lower blade 204 have planar major portions 218 and 220, respectively, each bent at the same substntial angle k to the planar edge portions 214 and 216, respectively, such that they are parallel. The bend in the upper blade 202 is positioned sufficiently rearward of the bend in the lower blade 204 that the gap 222 between the major portions 218 and 220 of the blades is greater than the gap between the edge portions 214 and 216 of the blades for the aforementioned purposes.

Figure 8:
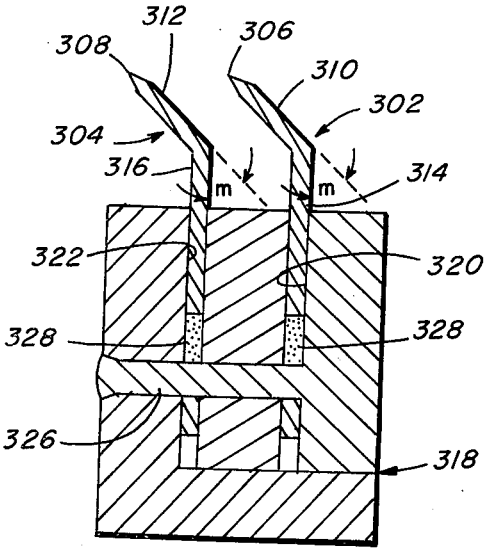
FIG. 8 is a sectional view of a razor blade assembly in which a pair of blades structured and positioned in general accordance with the invention are resiliently mounted for limited relative displacement therein.

FIG. 8 shows a razor blade assembly 300 in which a pair of razor blades 302 and 304 include cutting edges 306 and 308, respectively, at the front edges of planar edge portions 310 and 312, respectively, followed by planar major portions 314 and 316, respectively, each bent at the same substantial angle m to the respective planar edge portions. The blades 302 and 304 are mounted in a support 318, which may be integral with or removably mounted on the top of a razor handle (not shown).

Figure 7:
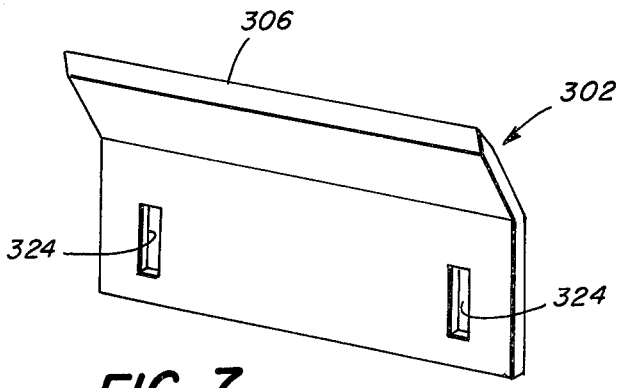
FIG. 7 is a perspective view of a razor blade in accordance with the invention and specifically as used in the embodiment of FIG. 8.

As illustrated in FIG. 8, support 318 is intended to slidably retain baldes 302 and 304 in parallel guide slots 320 and 322, respectively. The support 318 preferably only embraces the blades 302 and 304 at or near their opposite ends in the general manner of the aforementioned U.S. Pat. No. 4,168,571. However, in the illustrated embodiment, each blade, as represented by blade 302 in FIG. 7, is provided with a pair of vertically extending slots 324 through the major planar portion of the blade and elongated in a direction perpendicular to the blade cutting edge 306 to allow movement of the blade in that direction. The support 318 may be a composite structure which includes blade retainers 326 passing through the slots 324 for limiting the mortion of blades 302 and 304. Elastomeric pads 328 are mounted in the support 318 such that they contact an undersurface of the respective blades 302 and 304 to urge or bias the blade upwardly to the limit position illustrated in FIG. 8. For simplicity, the pads 328 are here illustrated as being mounted on the upper surfaces of blade retainers 326. It is intended that the aforementioned structure be functionally equivalent to the blade supporting structure in the aforementioned U.S. Pat. No. 4,168,571. Although not illustrated, the present embodiment may also include static or movable cap and guard members.

It will be appreciated that the twin bent blades 302 and 304 of the FIG. 8 embodiment are independently resiliently depressible in mutually parallel planes defined by their respective planar major portions 314 and 316 and the parallel guide slots 320 and 322. In accordance with the aforementioned embodiments of the invention (especially that of FIG. 6, the blades 302 and 304 are so positioned relative to one another that the gap between their major portions 314 and 316 is greater than the gap between their edge portions 310 and 312 to facilitate rinsability. Thus there is afforded a razor structure having a pair of blades resiliently mounted for independent displacement in response to shaving forces and so spaced and supported as to facilitate rinsability, yet in which the blades are formed simply by bending blades of relatively standard widths.

The configurations of the blades shown in the illustrative embodiments above are easily obtained by bending conventionally formed blades at some step in their manufacturing process. The advantages of a narrow blade are thus obtained without the manufacturing and assembling difficulties that narrow blades require.

There have been previous arrangements of two blades in an assembly in which one blade was not uniplanar. Examples of such arrangements are shown in U.S. Pat. No. 3,938,250 (Perry), French Pat. No. 974,180 (Patex), and U.S. Pat. No. 4,146,958 (Chen et al.). Among other distinguishing features, however, the prior art examples all show the major portions of the blade converging, or having smaller gaps, rather than diverging, or having larger gaps, behind the edge portions bearing the cutting edges.

The embodiments described above illustrate the invention in several forms. Other modifications of the embodiments, including deletions and additions, by those skilled in the art are contemplated and are within the scope of the invention as defined by the following claims.

I claim:

1. A razor assembly comprising razor blade support means, a first razor blade supported by said blade support means, comprising:

a first planar edge portion having a longitudinal cutting edge, and a first major planar portion continuous with said first planar edge portion; and a second blade supported by said blade support means comprising:

a second planar edge portion having a longitudinal cutting edge, and a second major planar portion continuous with and being disposed at a substantial angle to said second planar edge portion;

said first and second blades being arranged in said support means such that said first and second planar edge portions are substantially parallel and spaced apart and the gap between said first and second major portions of said blades is greater than the gap between said first and second edge portions, said blade support means includes means for resiliently supporting said first and second blades for independent movement in a direction within the plane of said first and second major planar portions, respectively.

2. A razor assembly comprising: razor blade support means affording limited blade motion, a pair of razor blades held movably by said support means, each blade defining a planar cutting portion including a cutting edge and a contiguous planar support portion, at least one blade being so shaped that its planar cutting portion is spaced a predetermined distance from and parallel to the corresponding portion of the other blade and said planar support portions of both said blades being spaced apart a distance greater than said predetermined distance, said blades being movable relative to one another through a limited stroke within said support means without disturbing the parallel relationship of said cutting portions.

3. A razor assembly comprising: resilient razor blade support means affording limited blade motion, a pair of razor blades held movably by said support means, each blade defining a planar cutting portion including a cutting edge and a contiguous planar support portion, said blades being so shaped that their planar cutting portions are spaced a predetermined distance from and parallel to one another and said planar support portions of both said blades being spaced apart a distance greater than said predetermined distance, said blades being movable relative to one another through a limited stroke within said resilient support means without disturbing the parallel relationship of said cutting portions.

* * * * *